United States Patent [19]

Michelman et al.

[11] 4,031,722

[45] June 28, 1977

[54] TAMPER-PROOF LOCKING DEVICE

[75] Inventors: Lionel S. Michelman, Pomona; Samuel M. Michelman; David L. Michelman, both of Queens; Milton Michelman, Long Beach, all of N.Y.

[73] Assignee: Michelman Iron Works Corporation, Brooklyn, N.Y.

[22] Filed: June 7, 1976

[21] Appl. No.: 693,293

[52] U.S. Cl. ..... 70/63; 70/77; 70/371; 292/258

[51] Int. Cl.[2] ..... E05B 65/52

[58] Field of Search ..... 70/32, 33, 34, 77, 78, 70/371; 292/256, 256.5, 258, 288, 340

[56] References Cited

UNITED STATES PATENTS

| | | | |
|---|---|---|---|
| 508,005 | 11/1893 | Feeney | 292/258 X |
| 3,938,939 | 2/1976 | Collier | 292/258 |
| 3,968,985 | 7/1976 | Nielsen | 292/340 |

FOREIGN PATENTS OR APPLICATIONS

| | | | |
|---|---|---|---|
| 1,292,033 | 4/1969 | Germany | 70/63 |

*Primary Examiner*—Robert L. Wolfe
*Attorney, Agent, or Firm*—Kirschstein, Kirschstein, Ottinger & Frank

[57] ABSTRACT

A locking device composed of two strips of metal bent into specific configurations to provide a tamper-proof assembly when emplaced on a lidded container. One strip is fixed to the container by a concealed screw within the container. The other strip overlies the lid and includes a portion superposed over a portion of the one strip. The aforesaid portions of the strips are provided with registered holes through which the shackle of a padlock is threaded to lock the assemblage in place and prevent the opening of the lid. The invention is applicable for locking any lidded boxes or containers, e.g. electric meter wiring cabinets, to prevent the tampering with elements within the box such as service wires interposing an electric meter between power lines and house lines.

11 Claims, 5 Drawing Figures

TAMPER-PROOF LOCKING DEVICE

BACKGROUND OF THE INVENTION

1. Field of the Invention

The invention relates to a tamper-proof locking device for lidded containers, to be used in conjunction with a padlock 2. Description of the Prior Art The necessity for locking containers is widely understood. Perhaps the most ubiquitous locking means and device of the prior art is a simple hinges hasp, i.e. a fastener for a door or lid consisting of a hinged metal strap provided with a slot, which fits over a staple and is secured by a pin or padlock. Such simple devices are objectionable for usage where inspection of the container is not frequent, e.g. in the case of meter wiring cabinets which contain the service wires that are connected to an electric meter, since a simple hasp is not tamper-proof. A major problem of electric utility companies, especially in urban areas, is that the wiring cabinets are broken open and the wires are tampered with to shunt the meter so that the customer can receive electricity without it being recorded. There are literally thousands of these boxes and cabinets in the average electric utility system which do not have any provision for a lock, or which are readily opened because, as presently constituted, they merely have a hasp or the like and are not tamper-proof.

SUMMARY OF THE INVENTION

1. Purposes of the Invention

It is an object of the present invention to provide a tamper-proof locking device.

Another object is to provide an improved locking device for the locking of cabinets, boxes, or any container provided with a lid.

A further object is to provide a locking device for the lid of a container which does not have any in situ provision for a lock.

An additional object is to provide a locking device which can be used on many different varieties and sizes of lidded boxes or containers of any type.

Still another object is to provide a locking device which is readily and simply installed.

Still a further object is to deter crime by providing a locking device which makes lidded containers tamper-proof.

Another object is to provide a universal locking device for the locking of a cover or lid on a vessel or container.

Another object is to provide a locking device which can be installed without destroying, cutting or drilling, or otherwise modifying, a lidded container.

Another object is to provide a locking device, for a lidded box or the like, which is installed in place without being permanently attached to the box.

These and other objects and advantages of the present invention will become evident from the description which follows.

2. Brief Description of the Invention

In the present invention, a tamper-proof locking device is provided which is characterized by the provision of two strip members usually composed of a suitable metal such as steel, wrought iron, brass and aluminum. Among the various types of steel which may be used, mild steel or case-hardened steel are preferred. The first strip member is of generally zig-zag or stepwise configuration and has three generally right-angled bends that divide the first member into four sections. None of the sections is opposite to another section, i.e. each bend is in an opposite direction from the adjacent bend or bends, so that each section is perpendicular to adjacent sections without being registered with another section, and a stepwise configuration is attained. One of the inner sections, i.e. a section other than an end section, is provided with at least one opening, i.e. a hole to accommodate the emplacement of the shackle of a padlock-like fastening device.

The second strip member has a generally U-shaped section and a planar section. As will appear infra, the U-shaped section serves to mount the second member on an edge of the box or other container, while the planar section is provided with at least one opening or hole to accommodate the lock mentioned supra. The U-shaped section is provided with a first leg and a second leg, the planar section extending laterally outwards perpendicularly to the lower end of the first leg. The second leg has a threaded opening through which screw means, e.g. a set screw, extends generally transversely to the second leg, so that the second member is secured to an edge of the container by inverting the U-shaped section, manipulating the second member relative to the container edge so that the edge of the container enters the U-shaped section and contacts the inner surface of the base of the U-shaped section and the legs straddle the edge and a wall of the container, and then turning the screw until the inner end of the screw is forced against the inner side of the wall of the container. The screw is located within the container so as to be concealed and protected when the container lid is closed. The lid then is closed and the first member emplaced so that an end section rests on top of the lid, the next (second) section overlies the aforesaid wall of the container, the next (third) section, this being the section with the opening therein, overlies the planar section of the second member, and the fourth section overlies the end edge of the planar section. The opening in the inner section is aligned with the opening in the planar section of the second member. Thus, the two members are now attachable to each other, and the container is locked shut in a tamper-proof manner, by the provision of a padlock the shackle of which extends through the aforesaid openings.

In most instances, both of the strip members generally will be of the same width; however, it is preferred that the first member be somewhat thicker than the second member, since structural rigidity and strength is more important and requisite for the first member, in order to prevent the bending, twisting or rotating of the first member which would allow a criminal easily to gain access to the interior of the container. A single sturdy padlock usually will be sufficient, and thus only a single hole ordinarily will be provided in the third section of the first strip member and also in the planar section of the second strip member.

When the edge of the container has an inwardly extending lip, the U-shaped section of the second member preferably will be provided with a generally planar base perpendicular to the legs, so that the two parallel legs are spaced apart a sufficient distance to accommodate the lip of the container when the second member is emplaced on an edge of the container.

It is preferred, for reasons of greater security, that the planar section of the second member be thicker than the U-shaped section of the second member, since the planar section, when the device is emplaced, is exposed and projects outwardly from the container parallel to the apertured third section of the first member. Thus, the planar section readily is accessible to a criminal, and the considerations discussed above with regard to the preferred greater thickness of the first member apply equally to the planar section of the second member. Greater thickness of the planar section conveniently is accomplished by retroverting, i.e. folding back, the end of the strip to provide a double thickness at the planar section, with the folded section being folded away from the U-shaped section of the second member, as will appear below. Alternatively, greater thickness of the planar section may be attained by fixing an apertured plate to the planar section of the second member, with the plate covering the planar section. The second member and the plate desirably will be composed of metal, and in this case the plate preferably is secured by being welded to the planar section of the second member.

The locking device of the present invention presents several salient advantages. The device essentially is tamper-proof, and thus the considerations developed above with regard to electric meter wiring cabinets or the like present an exemplary utility for the device. The device readily is installed in place without being permanently attached to the container or box or the like, and the locking device is installed without destroying, cutting or drilling, or otherwise modifying, the lidded container. The device is a universal locking device applicable to the locking of a cover or lid on a vessel or container or the like, or for the locking of virtually any enclosure elements which meet at substantially a right angle. The device deters crime with a locking device which makes lidded containers or the like essentially tamper-proof. The device is readly and simply installed, and may be used on many different varieties and sizes of lidded boxes, cabinets, or containers or the like, of any type. The term "lid" in this regard will be understood to encompass and include various types of doors, e.g. a door on a bathroom medical cabinet, in which instance the device could prevent children from swallowing deleterious, dangerous or poisonous medicines and the like often found in home medical cabinets. An important advantage is that the device is applicable where there is no in situ provision for a lock.

The invention accordingly consists in the features of construction, combinations of elements and arrangements of parts which will be exemplified in the devices hereinafter described and of which the scope of application will be indicated in the appended claims.

BRIEF DESCRIPTION OF THE DRAWINGS

In the accompanying drawings in which are shown various possible embodiments of the invention.

DETAILED DESCRIPTION OF THE PREFERRED EMODIMENTS

Figures 1, 2, 3, 4, 5:
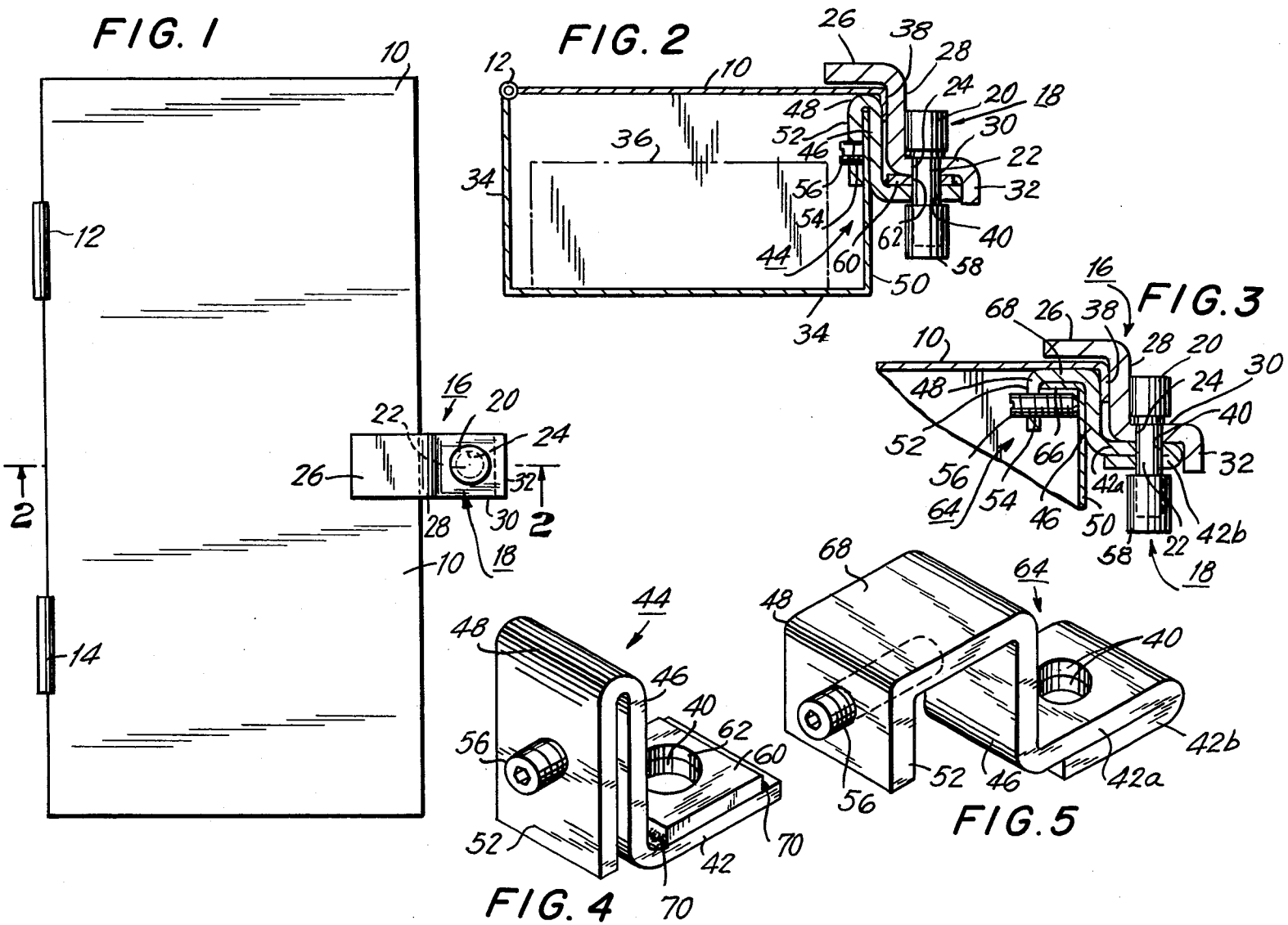
FIG. 1 is a plan view of the completed assemblage in place.
FIG. 2 is a sectional elevational view taken substantially along the line 2—2 of FIG. 1, and showing one embodiment of the invention.
FIG. 3 is a partial elevational sectional view similar to FIG. 2, but showing an alternative embodiment of the invention.
FIG. 4 is a perspective view of the second member of FIG. 2, alone.
FIG. 5 is a perspective view of the second member of FIG. 3, alone.

Referring now to FIG. 1, a lid 10 of a container such as an electric meter wiring cabinet is shown. The lid 10 is hinged to a container on one side by hinges 12 and 14, and the lid 10 is adapted to be locked to the opposite side wall to the container, not shown in this figure, by a locking device of first member 16 of the present invention, which locking device first member 16 is secured by a lock 18, that typically is a barrel lock as shown, having an upper head 20 and a dependent barrel 22 fixed thereto into which a key must be inserted to open the lock 18. The barrel 22 extends through an opening 24 in the member 16 in which it is a snug to loose fit that permits no more than negligible play therebetween. Only the first member 16 of the device appears in FIG. 1. This member 16 constitutes a first section 26 which rests on the outer surface of the lid 10 adjacent the side wall of the container remote from the hinges 12, 14, a second section 28 which depends from the outer end of section 26 at a generally right angle and overlies the outer surface of said wall of the container, a third section 30 which extends perpendicularly outwardly from the lower end of section 28 and is provided with the hole 24, and a stub fourth section 32 which depends perpendicularly from the end of section 30. The aforesaid disposition of the various sections of the first member 16 are with the lid 10 in a closed position. It will be apparent that the lid 10 may be suitably disposed on the top, or a side, or on the bottom of a container, depending on circumstances and usage.

Referring now to FIG. 2, the first member 16 is shown mounted on a container 34 (above alluded to) provided with the lid 10. Within the container 34 is an element 36 shown in phantom outline, which is desired to protect against unnoticed tampering, e.g. the connecting wires and junctions for an electric meter wiring cabinet. All edges but the hinged edge of the lid 10 typically are provided with a depending lip 38. However, such a lip is optional and may be omitted.

The sections 26, 28, 30 and 32 form, in combination, the first member 16 of the locking device and, as shown, these sections are oriented in a stepwise or right-angled zig-zag configuration. The barrel 22 of the lock 18 extends through the hole 24 in the section 30 in the fashion above noted and through a subjacent corresponding registered hole 40 in a planar section 42 of a second member 44 of the device in a similar fashion thus inhibiting any substantial relative movement between the members 16 and 14. The planar section 42 protrudes, i.e. extends outwardly, from the lower end of a first leg 46 of a generally U-shaped section 48 of the member 44, which section 48, as shown, is inverted and mounted on the wall 50 of the container 34 remote from the hinges 12, 14, so that the inner surface of the base of the section 48 rests on the upper edge of the wall 50 adjacent to the lid 10 when closed thereon. The section 48 is provided with a second leg 52 which is completely within the container 34 and is concealed when the lid is closed. The second member 44 is secured to the container 34 by a threaded bore 54 in the leg 52, through which a screw means 56, that is preferably a set screw, has been turned until the tip of the screw means 56 contacts and forceably presses against the inner surface of the wall 50 to securely fix the second member thereto. This, of course, was done while the lid 10 of the container 34 was raised to permit access to the interior of container 34. Thereafter, the lid 10 was closed, the first member was emplaced, and lock 18 was attached to the device. As shown, the lock 18 is provided with a cap member 58, which is securable to the barrel 22 by inserting a pin key, not shown, axially downwardly through the headed end of the barrel 22 to release an inner latch so that the cap member 58 is slidably movable upwardly, after which the pin key is removed so that the inner latch snaps outwardly into an inner groove within the cap member 58 to retain the cap member on the other end of the barrel.

In this embodiment of the invention, a metal plate 60 provided with a hole 62 is interposed between sections 30 and 42 of the first and second members 16 and 44. The plate 60 is fixed to the upper surface of the section 42 in order to provide added thickness and strength to this section, as discussed above. As will appear below, the plate 60 is welded to the section 42 by welding. The plate 60 in this embodiment is square. However, alternatively, the plate 60 may be of any other plan configuration, e.g. any sort of rectangular, circular or other shape. In many instances, it will be convenient to use a suitably sized circular washer as the plate. In addition, it is to be noted that the first member sections 26, 28, 30 and 32 are thicker than the second member sections 42 and 48, for reasons of added strength and rigidity as discussed above.

FIG. 3 illustrates an alternative embodiment of the invention, namely, a second member with a doubled planar section, said second member being adapted for installation on a container the edge of which is provided with an internal lip. Corresponding or identical parts in FIG. 3 which have been described supra with regard to FIG. 2 have been given the same reference numerals in FIG. 3. In this regard, the first member 16 is of the same configuration as previously described except that the thickness of the first member in FIG. 3 generally is the same as that of the second member, except for the retroverted (doubled-back) planar section of the second member.

The alternative second member is designated generally by the numeral 64. The upper edge of the wall 50 of the container is provided with an inwardly extending lip 66. To accommodate this lip, the U-shaped section 48 is provided with a flat planar base section 68 extending between legs 52 and 46, so that these legs are spaced apart sufficiently to receive the second member 64 on the upper edge of the wall 50. Concomitantly, the screw means 56 is elongated so as to reach from the leg 52 to the inner surface of the wall 50. The other distinguishing feature of the second member 64 is that the planar section 42 has been retroverted, i.e. folded back upon itself with the bend at its outer edge, so that the section 42 now consists of two portions **42*a* and 42*b*, with the hole 40 extending through both portions 42*a* and 42*b*. It is to be noted that, as shown, the end portion 42*b* is folded in a direction away from the U-shaped portion 48. The reasons for the retroversion of section 42 as shown in FIG. 3** are as explained above, i.e. for greater strength and rigidity of the locking device.

FIGS. 4 and 5 show details of the second members 44 and 64, respectively, in enlarged perspective views. The structural characteristics of these members are thus readily apparent. Referring to FIG. 4, the plate 60 is secured to the surface of planar section 42 by means of perimetral welding 70.

In the device as installed on a closed container and employing the first described second member, the second member 44 is seated on the container wall 50 remote from the hinges 12, 14 with its leg 52 within the container and fastened to the wall 50 by the set screw 56. The other leg 46 is flat against the outer surface of the wall 50. The section 42 extends away from said wall 50. Thus, the second member is secured rigidly to the container and cannot readily be removed from it as long as the lid remains closed. The first member 16 simply rests on the container. Its first section 26 lies on the outer surface of the lid at the portion of the lid remote from the hinges 12, 14 and aligned with the second member. The outer end of the first section 26 reaches the edge of the lid. The second section 28 of the first member extends vertically downwardly from the first section to overlie the associated segment of the lid 10 and the leg 46 of the second member. The third section 30 of the first member overlies the section 42 of the second member (considering the plate 60 as a unitary part of the section 42). Finally, the stub fourth section 32 of the first member overlies the tip (outer edge) of the section 42 whereby to protect and conceal the same and minimize relative angular movement of the members 16, 44 about the central axis of the barrel 22. Thereby, once the barrel lock 18 is engaged and the barrel 22 fills the holes 24, 40, the first member only can shift slightly with respect to the fixed second member so that the lid is locked in closed position and is most difficult to remove with a wrench or a pry, common tools of a criminal.

The same description applies to the second described embodiment of the invention.

It thus will be seen that there are provided tamper-proof locking devices which achieve the various objects of the invention and which are well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having thus described the invention, there is claimed as new and desired to be secured by Letters Patent:

1. A tamper-proof locking device mountable on a lidded container or the like comprising a first member and a second member, said first member comprising a generally zig-zag strip having three substantially right-angled bends, so that said first member is divided into four sections, with none of said sections being directly opposite to another section, an inner one of said sections being provided with at least one opening, said second member comprising a strip having a generally U-shaped section and a projecting section, said U-shaped section having a first leg and a second leg, said projecting section extending laterally outwards from and substantially perpendicular to the lower end of the first leg of said U-shaped section and being provided with at least one opening, the second leg of said U-shaped section being provided with a threaded bore, and screw means extending through the bore in said second leg, so that the locking device is mountable on a lidded container by placing the U-shaped section of the second member on a wall of a container with said legs straddling said wall and with said second leg and said screw means within the container, turning said screw means until the tip of said screw means contacts and presses against the wall of the container, closing the lid of the container so that the edge of the lid rests on the base of said U-shaped section, and mounting said first member on both the edge of the lid and the projecting section of the second member with one end section of the first member extending over the edge of the lid, one inner section of the first member overlying the first leg of the U-shaped section, the other inner section of the first member overylying the projecting member and the other end section of the first member extending over the tip of the projecting section of the second member, so that said members are attachable to each other by lock means having a shackle extending through the opening in said inner one of said sections of said first member and the opening in said projecting section of said second member.

2. The locking device of claim 1 in which both of the members are of substantially the same width.

3. The locking device of claim 1 in which the first member is thicker than the second member.

4. The locking device of claim 1 in which both of the members are composed of a metal.

5. The locking device of claim 4 in which the metal is a steel selected from the group consisting of mild steel and case-hardened steel.

6. The locking device of claim 1 in which the U-shaped section of the second member is provided with a generally planar base perpendicular to the legs, whereby the legs are spaced apart.

7. The locking device of claim 1 in which the projecting section of the second member is thicker than the U-shaped section.

8. The locking device of claim 7 in which the projecting section is a retroverted section of the strip, the folded section being folded away from the U-shaped section of the second member.

9. The locking device of claim 7 in which an apertured plate is secured to the projecting section of the second member, said plate covering substantially the entire surface of the projecting section.

10. The locking device of claim 9 in which the second member and the plate are composed of metal and the plate is welded to the projecting section of the second member.

11. The locking device of claim 1 in which the lock means is a barrel lock.

* * * * *